US006102425A

United States Patent [19]

Götzfried

[11] Patent Number: 6,102,425

[45] **Date of Patent: *Aug. 15, 2000**

[54] DEVICE FOR PURPOSELY INFLUENCING THE LONGITUDINAL CURVATURE OF A SKI

[75] Inventor: Peter Götzfried, Sonthofen, Germany

[73] Assignee: Sabine Götzfried and Karl Peter Ernst Götzfried, Sonthofen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,741

[22] PCT Filed: Feb. 25, 1995

[86] PCT No.: PCT/EP95/00687

§ 371 Date: Apr. 19, 1996

§ 102(e) Date: Apr. 19, 1996

[87] PCT Pub. No.: WO95/32035

PCT Pub. Date: Nov. 30, 1995

[30] Foreign Application Priority Data

May 21, 1994 [DE] Germany ..... 44 17 937

[51] Int. Cl.[7] ..... A63C 5/07

[52] U.S. Cl. ..... 280/602; 280/623

[58] Field of Search ..... 280/602, 607, 280/623, 634, 636, 611

[56] References Cited

U.S. PATENT DOCUMENTS

| | | | |
|---|---|---|---|
| 3,260,532 | 7/1966 | Heuvel | 280/602 |
| 3,504,922 | 4/1970 | Wiley | 280/623 |
| 5,143,395 | 9/1992 | Mayr | 280/602 |
| 5,215,326 | 6/1993 | Baron et al. | 280/636 |
| 5,253,894 | 10/1993 | Thomas et al. | 280/607 |
| 5,324,062 | 6/1994 | Rigal et al. | 280/607 |
| 5,332,253 | 7/1994 | Couderc et al. | 280/602 |
| 5,480,175 | 1/1996 | Astier et al. | 280/602 |

FOREIGN PATENT DOCUMENTS

| | | |
|---|---|---|
| 2655867 | 6/1991 | France . |
| 9102551 | 7/1991 | Germany . |
| 9222361 | 12/1992 | WIPO . |

*Primary Examiner*—J. J. Swann
*Assistant Examiner*—David R. Dunn
*Attorney, Agent, or Firm*—Gilberto M. Villacorta; Suresh Koshy; Pepper Hamilton LLP

[57] ABSTRACT

Skis are manufactured so as to have a convex longitudinal curvature in the unloaded state. This ensures that the ski has good contact with the snow, keeps to the track and does not chatter during skiing, but impedes turning the skis and skiing through narrow curves. However, by securing two Z-shaped rigid levers (10) with a power arm (11) and a load arm (12) to a ski (1) such that the power arms (11) are positioned under the heel or toe of a ski boot and by variously distributing the weight (Gh, Gv) on the power arms (11), the tail (3) and/or tip (2) of the ski are/is lifted and the ski (1) obtains a concave longitudinal curvature.

2 Claims, 4 Drawing Sheets

DEVICE FOR PURPOSELY INFLUENCING THE LONGITUDINAL CURVATURE OF A SKI

BACKGROUND OF THE INVENTION

1. Field of the Invention

The invention is directed to devices for purposely influencing the longitudinal curvature of a ski.

2. Description of the Related Art

Alpine skis are manufactured so as to have a convex curvature in the central region where the ski binding is mounted. This longitudinal curvature disappears under the influence of the weight of the skier; the tip and the tail of the ski are pressed into the snow simultaneously with corresponding forces. In this way, the ski has good contact with the snow, keeps its track and does not chatter while running, etc.

However, this convex longitudinal curvature also has disadvantages. It impedes the turning of the ski. The skier must improve the turning of the skis—if necessary, by actively shifting his or her weight up or down. Exhibition skiers prefer short skis with a slight longitudinal curvature. However, these skis handle poorly in straight running.

A further disadvantage of the convex longitudinal curvature consists in that it impedes skiing through curves, especially with edge engagement of the ski, since the natural longitudinal curvature of the ski is exactly the reverse of the curvature required for skiing through curves. This is why ski racers prefer skis with a substantial sidecut which are considerably wider in the region of the tip and the tail than in the area of the binding. The greater this sidecut, the narrower the curves which can be skied. However, various accidents, of which some have unfortunately been fatal, show that there are severe problems associated with the riding characteristics of skis with these sharp sidecuts.

SUMMARY OF THE INVENTION

It is the object of the present invention to provide the simplest possible device by means of which the skier can deliberately change the longitudinal curvature of the ski from the original convex shape to a more or less concave shape while skiing.

In accordance with the present invention, the device for purposely influencing the longitudinal curvature of a ski, wherein the ski is equipped with a ski binding for securing a ski boot in a detachable manner, includes a rigid lever mounted at the heel of the boot and/or a rigid lever mounted at the tip of the boot, wherein each lever has a power arm and a load arm, the load arm facing away from the heel or the tip of the ski boot and being rigidly connected to the ski, and wherein each power arm is positioned under the ski boot and spaced from the ski, such that a pressure can be applied on the power arm by the heel or the tip of the boot and a bending moment is exerted on the ski through the rigid lever.

As a result of the lever according to the invention, the skier can purposely bend the portion of the ski connected with the load arm of the lever by means of a proportioned shifting of his or her weight on the power arm so that even a concave longitudinal curvature can be achieved. Any ski can be retrofitted with the lever according to the invention. It can be adjusted individually to a particular shoe size. By changing the length of the power arm, the weight of the skier and the elasticity of the ski can be adapted to one another. A ski which is outfitted with two levers according to the invention can be turned with substantially more sensitivity without losing the edge grip required in the swing control phase or forfeiting dynamics. The skier can achieve this by shifting his or her weight in the direction of the tip of the ski when initiating the turn so that the toe of the ski boot exerts pressure on the power arm of the front lever, whereupon its load arm pulls the tip of the ski upward. Further, a ski which is outfitted with two levers according to the invention has a slightly concave bend, even when edge-up, which facilitates turning but, at the same time, ensures that the ski has a very good edge grip below the binding where it is most meaningful and important, such an edge grip being indispensable for skiing on ice. A shifting of body weight toward the front or toward the rear is transmitted to the ski by means of the lever effect so that the ski can be brought under control easily and with little expenditure of force in any situation.

Ski racers can also profit substantially by the present invention. When the racer travels through a curve at high speed with skis on edge, centrifugal forces are generated which substantially increase the skier's effective weight. Additional forces are accordingly exerted on both levers so that the tip of the ski and the tail of the ski are pulled upward to a corresponding degree and the ski obtains a concave longitudinal curvature which is optimal for skiing through narrow curves. This effect is also present in skis with a less pronounced sidecut.

The present invention is not to be confused with the familiar mounting of the ski binding at an intermediate plate which is in turn mounted at a distance from the ski as is described, for example, in DE-A 41 00 327 or DE-A 43 18 513. The primary task of these known devices is only to prevent the ski boot from contacting the snow when edging the skis. A second purpose of these known devices is to uncouple the intermediate support plate from the ski so that the ski retains its natural elasticity, as the intermediate support plate must be rigid so that the ski binding can disengage reliably during a fall, etc. The third purpose of the device according to DE-A-41 00 327 is further to enable positioning of the points at which forces are transmitted between the skier or ski binding and the ski regardless of boot size.

It will be readily understood that this distance between the ski binding and the ski can also be produced by means of the lever according to the invention. Therefore, according to a preferred construction of the invention, the appropriate part of the ski binding is directly attached to the power arm of the lever. For example, the ski binding is fastened by screws at ready-made bore holes. However, it is also possible to integrate the lever in the ski binding or in the ski.

Since the skier's weight is constantly acting directly on the power arm of the lever according to the invention when positioning the ski binding and there is a risk that the natural longitudinal curvature of the ski will be canceled or even reversed, a spring which compensates for at least part of the skier's weight is advisably positioned between the ski and the power arm.

This spring is preferably fashioned from a block of resilient material of suitable hardness, especially plastic or rubber, which completely fills the intermediate space between the power arm and ski so that ice and snow cannot penetrate.

Another development of the invention provides for a vertical stop which limits the movement of the power arm away from the ski. This stop serves to improve skiing safety in that it prevents the toe of the ski boot from pulling the power arm of the front lever upward in the event of an extreme shifting of weight, e.g., toward the rear, which would result in the ski tip pressing heavily down into the snow or in a retardation of the release behavior of the ski binding.

BRIEF DESCRIPTION OF THE DRAWING

The invention, further developments thereof which are defined in the subclaims, and its advantages are described more fully in the form of embodiment examples with reference to the drawing.

The principle underlying the invention will be explained with reference to FIGS. 1 to 3.

Figure 1:
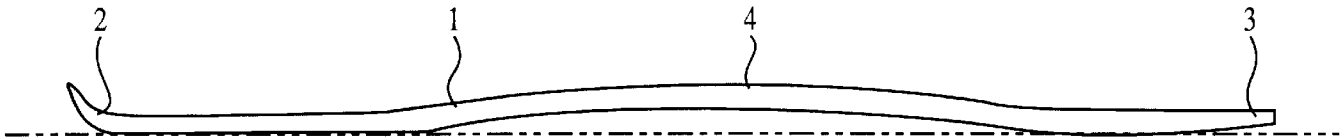
FIG. 1 shows a side view of a conventional ski which is not in the loaded state.

FIG. 1 shows a conventional ski 1, not loaded, with tip 2 and tail 3. The middle region 4 where the ski binding is mounted has a convex longitudinal curvature or camber.

Figure 2:
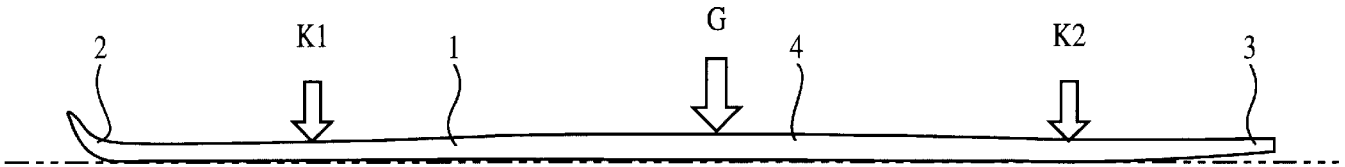
FIG. 2 shows a side view of a conventional ski in the loaded state.

FIG. 2 shows the ski of FIG. 1 loaded by the weight G of a skier. The middle region 4 is now flat. The tip of the ski and the tail of the ski press on the supporting base with force K1 and K2, respectively.

Figure 3:
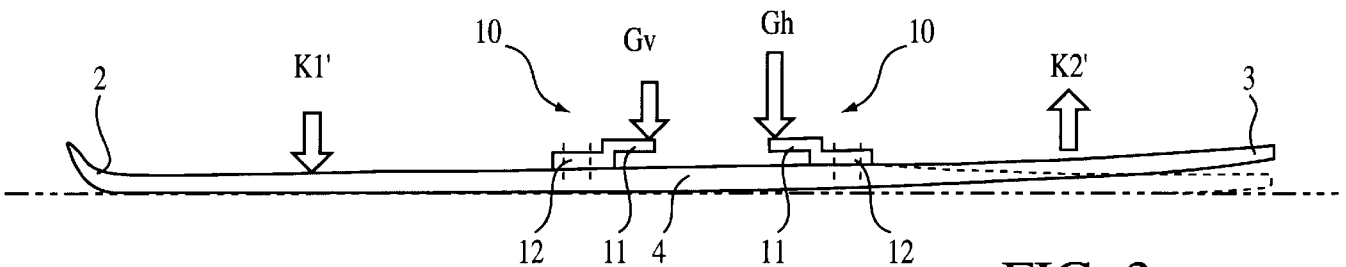
FIG. 3 shows a side view of a conventional ski which is outfitted with two levers according to the invention.

FIG. 3 shows the ski of FIG. 2, but with two additionally mounted, rigid Z-shaped levers 10 with a power arm 11 and a load arm 12. The power arms 11 are so positioned that they can be loaded by the heel or toe of a ski boot (not shown). The load arms 12 are connected with the ski 1 in a stationary manner.

In the example shown in FIG. 3, the power arm 11 of the lever 10 associated with the tail 3 of the ski is loaded by the greater partial weight Gh and the force arm 11 of the lever 10 associated with the ski tip 2 is loaded by the smaller portion of weight Gv. This weight distribution results, for example, when a skier (not shown) shifts his or her body weight toward the rear. The partial weight Gh presses the power arm 11 of the lever 10 down. The load arm 12 of the rigid lever 10 and, along with it, the tail 3 of the ski are accordingly swiveled upward. An upwardly directed force K2' acts on the tail 3 of the ski.

However, when the body weight is shifted to the rear, the ski tip 2 is also partially unweighted and now only presses on the supporting base with the relatively small force K1'. The ski 1 has a substantially concave longitudinal curvature. It can be turned easily. It is possible to ski through narrow curves with edge-up skis having a concave curvature.

It will be readily understood that the ski tip 2 can be lifted from the supporting base when the body weight is shifted to the lever 10 associated with the ski tip 2.

Further, it will be readily understood that when the skier's effective body weight is increased, e.g., as a result of centrifugal force when skiing quickly through narrow curves, both levers 10 are additionally loaded, thereby increasing the concave longitudinal curvature of the ski 1 which provides optimum support for skiing through curves. As soon as the skier flattens out the ski 1 again, these additional forces disappear and the ski 1 reassumes its customary characteristics.

Figure 4:
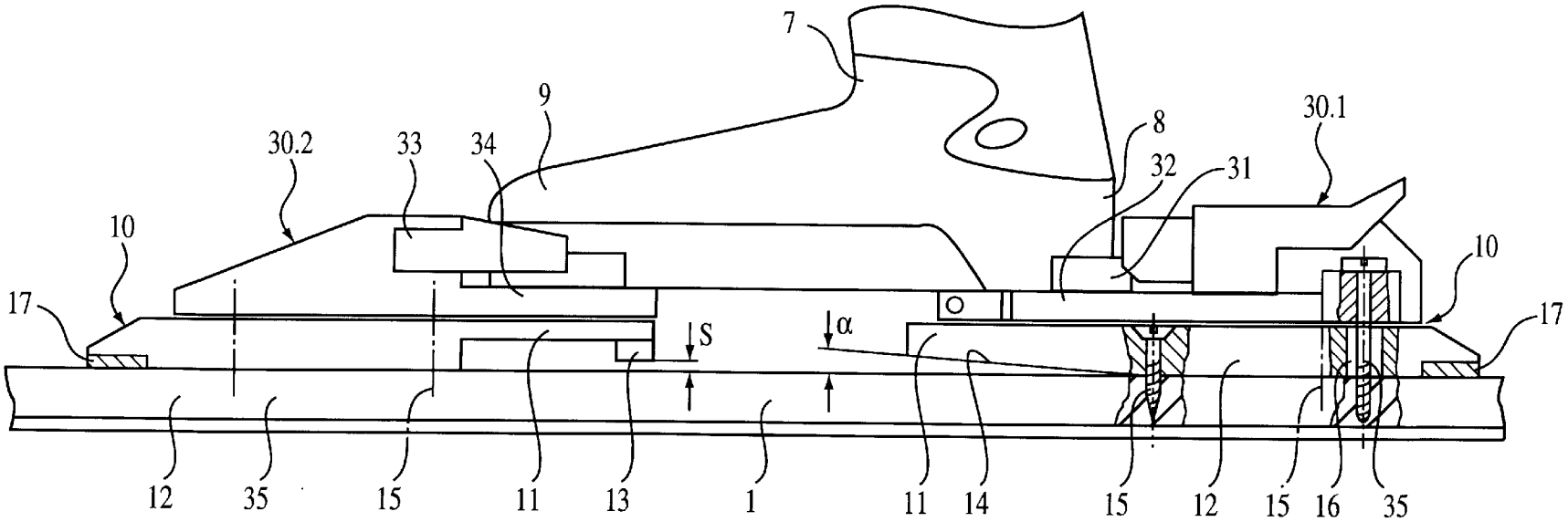
FIG. 4 shows a view in enlarged scale of a first embodiment example of a ski which is outfitted with the levers according to the invention and with a conventional ski binding.

FIG. 4 shows a first embodiment example of the lever 10 according to the invention on a downhill ski 1 which is shown in section.

Each load arm 12 of the two Z-shaped rigid levers 10 is screwed tightly to the ski 1 by means of four screws 15. A conventional ski binding 30.1, 30.2 is positioned above the two levers 10 and is attached to the ski 1 by screws 35. The screws 35 are inserted into the levers 10 without touching through widened openings 16.

A ski boot 7 with heel 8 and toe 9 is secured between the retaining plates 32, 34 and the retaining jaws 31, 33 of the ski binding 30.1, 30.2.

The power arms 11 of the two levers 10 are so positioned that a skier can exert pressure on them with the heel 8 or toe 9 of the ski boot 7, which changes the corresponding part of the ski.

FIG. 4 also shows two examples of devices which serve to limit the spring path of the power arms 11 of the levers 10 and accordingly the magnitude of the maximum possible concave longitudinal curvature of the ski 1. A stop block 13 which limits the movement of the power arm 11 to the height of gap S is mounted below the power arm 11 of the lever 10 shown on the left-hand side of the drawing. The stop block 13 can also be mounted on the ski 1.

The power arm 11 of the lever 10 shown on the right-hand side of the drawing is outfitted on its underside with a wedge 14 which encloses an angle alpha relative to the upper edge of the ski. The power arm 11 can only be moved until the wedge 14 rests flat on the ski 1.

Finally, it can also be seen from FIG. 4 that the load arms 12 of the levers 10 have, at their free end, a cut out portion which faces the ski 1 and is filled with a resilient material 17. The resilient layer 17 allows the ski to spring while running, also when using long levers 10 due to a correspondingly long construction of the ski bindings 30.1, 30.2, and prevents ice and snow from penetrating.

Figure 5:
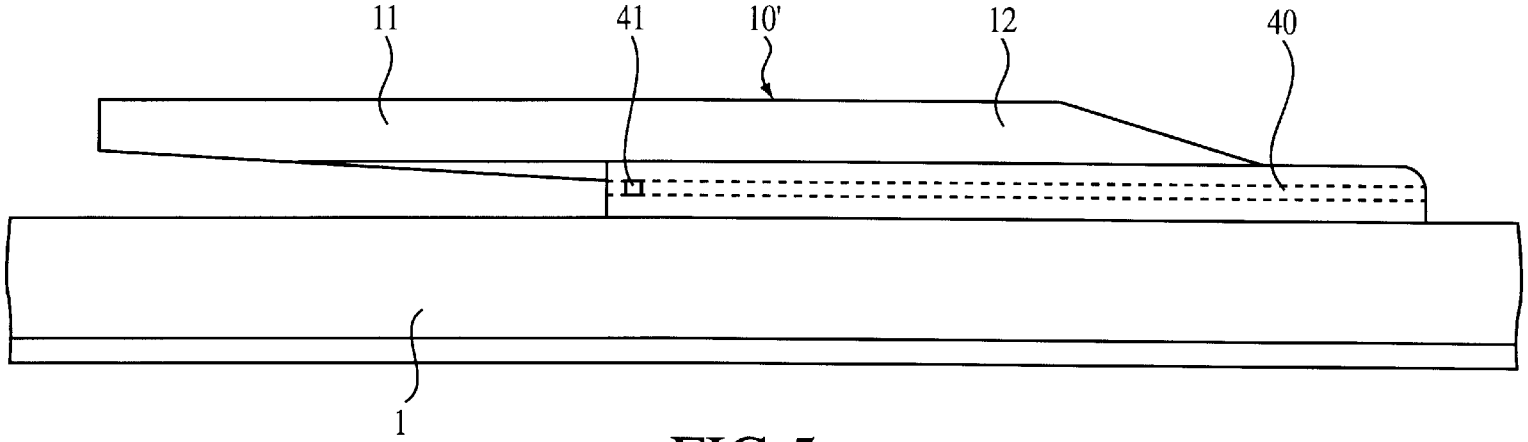
FIG. 5 shows a second embodiment example.

FIG. 5 shows an alternative possibility for fastening a lever 10'. Mounted on the ski 1 is a C-rail 40 in which the load arm 12 of the lever 10' can be aligned in the longitudinal direction of the ski and fixed by means of a stopper 41.

Figure 6:
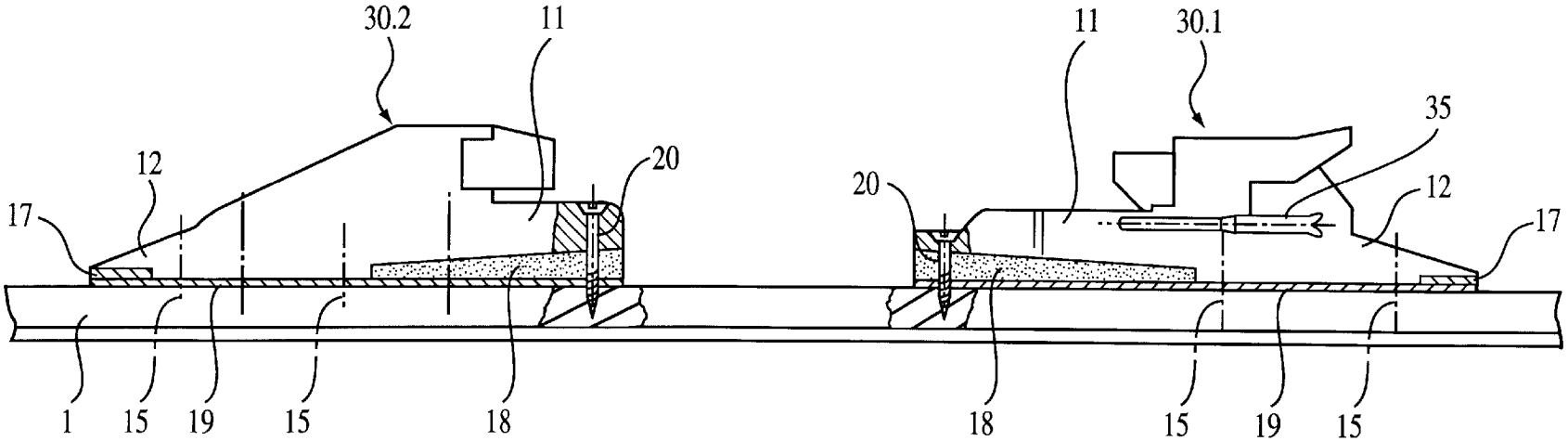
FIG. 6 shows an embodiment example of a ski with levers according to the invention and with an integrated ski binding.

FIG. 6 again shows a section of a downhill ski in which the ski binding 30.1, 30.2 is integrated on the levers 10. The load arms 12 are attached to the ski by screws 15, but also, in this case, with a thin intermediate layer 19 which can compensate for any unevenness.

The gap between the power arms 11 and the ski 1 is filled with an insert 18, especially one made of plastic or rubber. On the one hand, this prevents ice and snow from penetrating. But the resilient insert 18 also acts as a spring and so compensates at least partially for the basic weight of a skier. For this purpose, the Shore hardness of the insert 18 is selected in accordance with the weight of the skier. Accordingly, when the skier distributes his or her weight evenly on the front and rear lever 10, the power arms 11 remain in their basic position and the ski 1 retains its normal characteristics.

A vertical stop 20, which in this instance is in the form of a screw which is countersunk to an appropriate depth, is provided to prevent the power arms 11 from being pushed or pulled upward.

Figure 7:
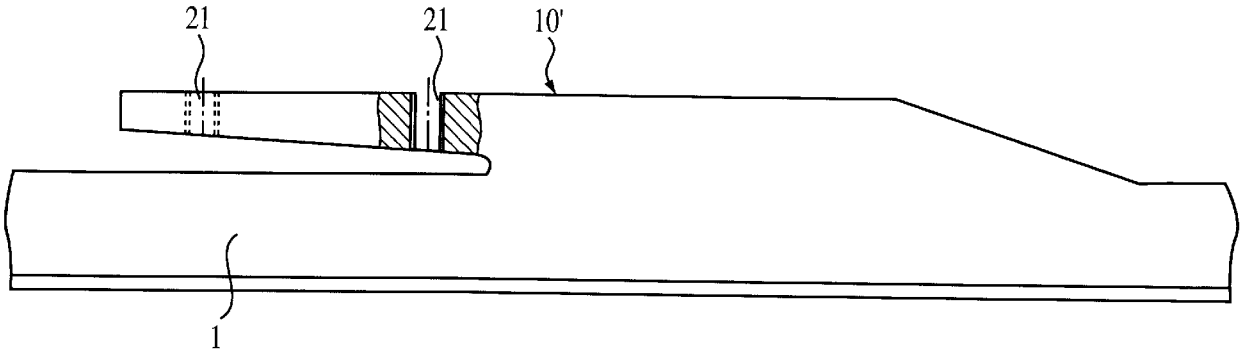
FIG. 7 shows a fourth embodiment example in section.

FIG. 7 shows a modified embodiment form of a ski 1'. In this case, the load arm of the lever 10' is integrated in the ski 1'. The power arm 11 has ready-made bore holes 21, if necessary with threads, for easy attachment of a ski binding.

Figure 8:
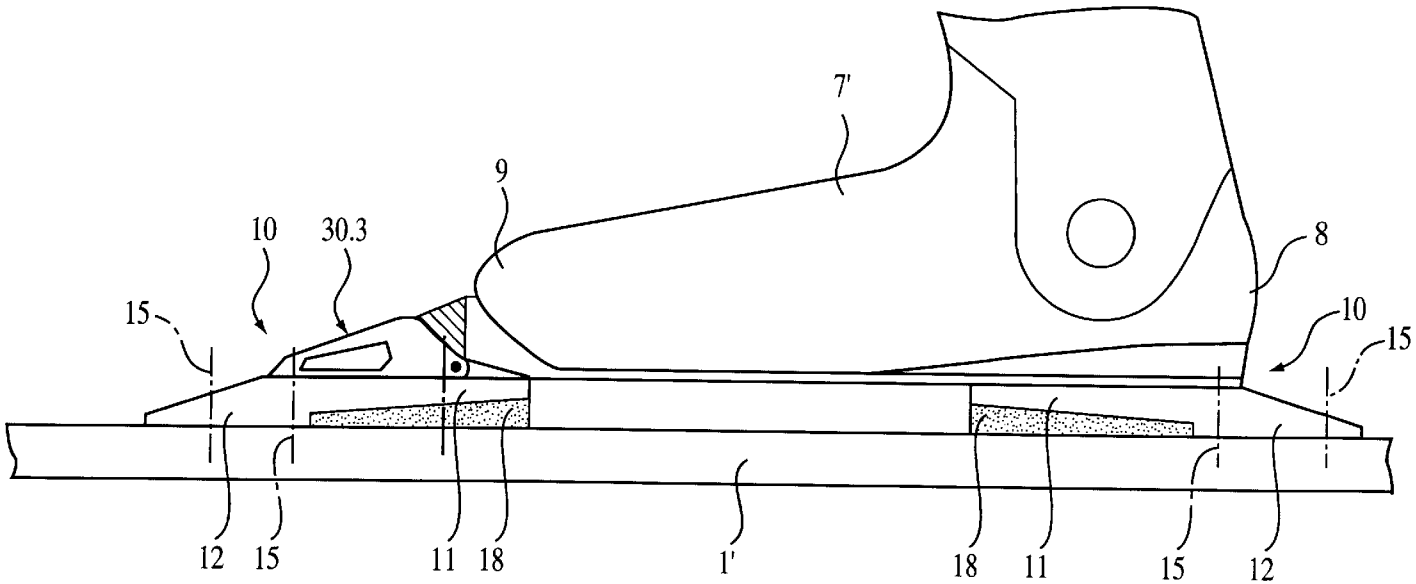
FIG. 8 shows an embodiment example with a cross-country ski.

Finally, FIG. 8 shows that the levers according to the invention can also be applied in a cross-country ski 1'. In this case, only the lever 10 facing the tip of the ski carries a ski binding 30.3 which secures the tip 9 of the cross-country ski boot 7'. The heel 8 of the cross-country ski boot 7' is free as is customary in cross-country skiing.

Nevertheless, it is also possible in this case to control the longitudinal curvature of the cross-country ski 1' in the desired manner by shifting the body weight on the heel 8 or toe 9.

The invention is used in all types of skis.

I claim:

1. A device for purposely influencing a longitudinal curvature of a ski, wherein the ski is equipped with a ski binding for securing a ski boot in a detachable manner, the device comprising at least one of a first rigid lever mounted at a ski boot heel and a second rigid lever mounted at a ski boot tip, each of said at least one rigid lever comprising a load arm rigidly attached to the ski, the load arm of the first rigid lever, if present, facing away from the ski boot heel and the load arm of the second rigid lever, if present, facing away from the ski boot tip, each of said at least one rigid lever further comprising a power arm adapted to be positioned under the ski boot and spaced from the ski, wherein each of said at least one rigid lever has such a stiffness that a pressure applied to the power arm causes a bending moment to be exerted on the ski, wherein the load arm has a free end, the free end having a cut-out portion directed toward the ski, wherein the cut-out portion of the load arm is filled with a material of selected hardness.

2. The device according to claim 1, wherein the material is plastic or rubber.

* * * * *